US011632611B1

(12) United States Patent
Sulzer et al.

(10) Patent No.: US 11,632,611 B1
(45) Date of Patent: Apr. 18, 2023

(54) LOUDSPEAKER HAVING A CHANNEL FOR CONVEYING WATER

(71) Applicant: Robert Bosch GmbH, Stuttgart (DE)

(72) Inventors: Nicholas Sulzer, Mosinee, WI (US); Michael D. Kasten, Burnsville, MN (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/697,091

(22) Filed: Mar. 17, 2022

(51) Int. Cl.
*H04R 1/02* (2006.01)

(52) U.S. Cl.
CPC ..... *H04R 1/025* (2013.01); *H04R 1/023* (2013.01); *H04R 1/026* (2013.01)

(58) Field of Classification Search
CPC ..... H04R 1/025; H04R 1/023; H04R 1/026
USPC ..... 381/332
See application file for complete search history.

(56) References Cited

U.S. PATENT DOCUMENTS

| | | | | |
|---|---|---|---|---|
| 4,173,267 | A | 11/1979 | Chatani | |
| 4,196,791 | A | 4/1980 | Gottlieb | |
| 4,562,590 | A | 12/1985 | DeLage | |
| 4,860,367 | A | 8/1989 | Hook | |
| 6,144,752 | A | 11/2000 | Chen | |
| 6,731,765 | B1 | 5/2004 | Sotome | |
| D595,261 | S | 6/2009 | Xie et al. | |
| 7,590,257 | B1 | 9/2009 | Blanchard et al. | |
| 8,224,001 | B1 | 7/2012 | Waller | |
| D756,328 | S | 5/2016 | Warden | |
| D886,776 | S | 6/2020 | Bunning et al. | |
| 2004/0251079 | A1* | 12/2004 | Plummer | H04R 1/2857 181/156 |
| 2006/0029241 | A1 | 2/2006 | Graber | |
| 2006/0177089 | A1* | 8/2006 | Greco | H04R 1/023 381/391 |
| 2009/0028370 | A1* | 1/2009 | Matsumura | H04R 3/002 381/86 |
| 2009/0046875 | A1 | 2/2009 | Masuda | |
| 2016/0094911 | A1* | 3/2016 | Kropf | H04R 1/44 381/334 |

* cited by examiner

*Primary Examiner* — Sean H Nguyen
(74) *Attorney, Agent, or Firm* — Michael Best & Friedrich LLP

(57) ABSTRACT

A loudspeaker includes an enclosure having an open front side defining a forward direction for projecting sound, a first support surface configured to support the loudspeaker in a monitor orientation, and a second support surface configured to support the loudspeaker in an upright orientation. In the monitor orientation, the forward direction is arranged at an oblique upward angle relative to a surface on which the enclosure is placed. The loudspeaker also includes an audio transducer positioned within the enclosure and configured to emit sound from the open front side of the enclosure, and a baffle securing the audio transducer to the enclosure. The baffle has a front surface facing in the forward direction and a channel formed in the front surface. The channel is configured to direct water out of the enclosure in the monitor orientation.

20 Claims, 5 Drawing Sheets

LOUDSPEAKER HAVING A CHANNEL FOR CONVEYING WATER

BACKGROUND

The present invention relates generally to the field of loudspeakers such as those used in small and large venues for public address and/or delivery of a musical performance to an audience.

SUMMARY

In one aspect, the invention provides a loudspeaker including an enclosure having an open front side defining a forward direction for projecting sound, a first support surface configured to support the loudspeaker in a monitor orientation, and a second support surface configured to support the loudspeaker in an upright orientation. In the monitor orientation, the forward direction is arranged at an oblique upward angle relative to a surface on which the enclosure is placed. The loudspeaker also includes an audio transducer positioned within the enclosure and configured to emit sound from the open front side of the enclosure, and a baffle securing the audio transducer to the enclosure. The baffle has a front surface facing in the forward direction and a channel formed in the front surface. The channel is configured to direct water out of the enclosure in the monitor orientation.

In another aspect, the invention provides a loudspeaker including an enclosure having an open front side defining a forward direction for projecting sound, a first support surface configured to support the loudspeaker in a monitor orientation, and a second support surface configured to support the loudspeaker in an upright orientation. In the monitor orientation, the forward direction is arranged at an oblique upward angle relative to a surface on which the enclosure is placed. The loudspeaker also includes an audio transducer positioned within the enclosure and configured to emit sound from the open front side of the enclosure. The loudspeaker also includes a baffle positioned in the open front side of the enclosure and having an opening configured to receive the audio transducer. The baffle has a front surface facing the forward direction and a channel formed in the front surface. The channel has a first wall adjacent the audio transducer and a second wall adjacent a port of the loudspeaker. The second wall extends further in the forward direction than the first wall in a region of the port. The baffle has a first portion having the channel and a cover disposed further in the forward direction than the first portion. An edge of the cover and the first portion define an exterior opening of the port.

In yet another aspect, the invention provides a method of channeling water out of a loudspeaker. The method includes providing the loudspeaker having an enclosure having an open front side defining a forward direction for projecting sound, an audio transducer positioned within the enclosure and configured to emit sound from the open front side of the enclosure, and a baffle securing the audio transducer to the enclosure. The baffle has a front surface facing in the forward direction, a channel formed in the front surface, a first portion having the channel and a second portion having a cover disposed further in the forward direction than the first portion, the cover and an end of the first portion defining an exterior opening of the port. The method also includes placing the loudspeaker in a monitor orientation on a floor surface such that the forward direction is at an upward oblique angle with respect to the floor surface, receiving water on the front surface of the baffle, directing the water over an edge of the cover, and directing the water along the channel by gravity.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
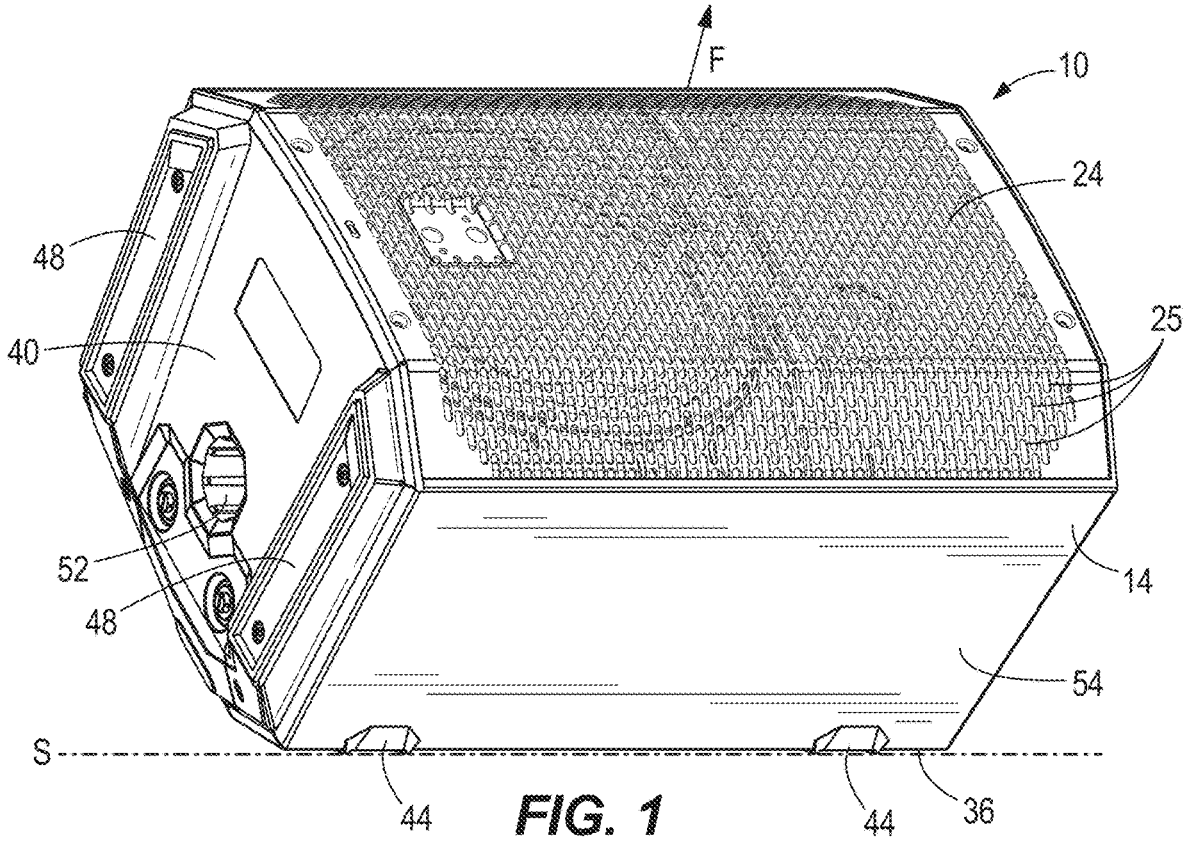
FIG. 1 is a perspective view of a loudspeaker according to one embodiment of the present disclosure in a monitor orientation.
Figure 2:
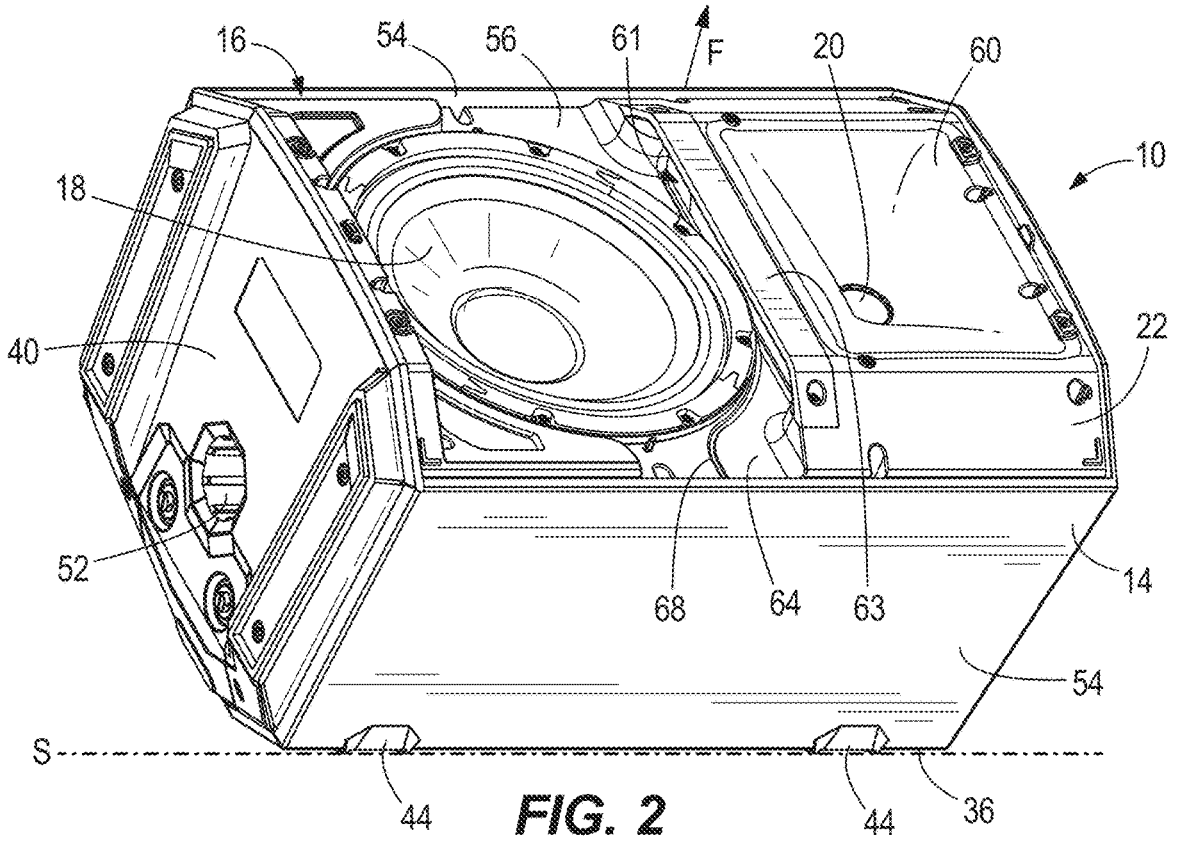
FIG. 2 is a perspective view of the loudspeaker of FIG. 1, shown without a grille, in the monitor orientation.
Figure 3:
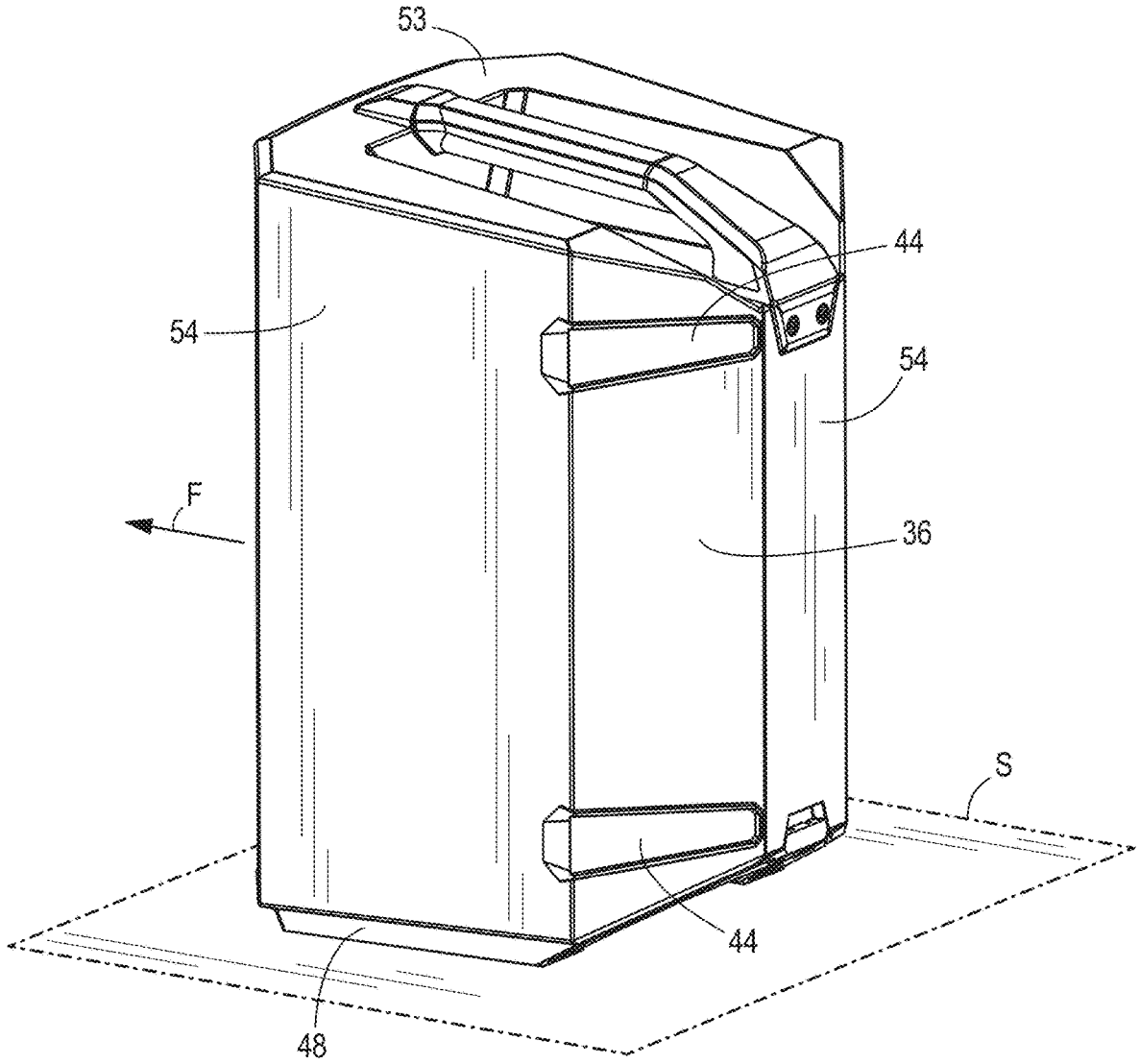
FIG. 3 is a rear perspective view of the loudspeaker of FIG. 1 in an upright position.

A loudspeaker 10, as shown in FIGS. 1-3, includes an enclosure 14. In some scenarios, the loudspeaker assembly 10 can be arranged on a floor surface S so that sound may be directed upwards toward a performer in a monitor orientation, shown in FIGS. 1 and 2. The loudspeaker assembly 10 may be mounted on a pole or may be set on a surface S such as a stage or a floor, in an upright orientation, shown in FIG. 3. The enclosure 14 has an open front side 16 defining a forward direction F for projecting sound.

The loudspeaker 10 additionally includes a first audio transducer 18 positioned within the enclosure 14, a second audio transducer 20 positioned within the enclosure 14, and a baffle 22 securing the first audio transducer 18 and the second audio transducer 20 to the enclosure 14. The baffle 22 is positioned in the enclosure 14 adjacent the open front side 16. The loudspeaker 10 also includes a grille 24 at least partially closing the open front side 16, although the grille 24 is sound transmissive so that sound from the transducers 18, 20 is projected through the grille 24. In some embodiments, the grille 24 covers the open front side 16 of the enclosure 14 and the baffle 22. The grille 24 may be a rigid or flexible grille material and may be positioned over the first transducer 18 and the second transducer 20. The grille 24 is a perforated grille and includes a plurality of holes 25.

The first transducer 18 and the second transducer 20 are capable of reproducing one or more acoustic signals within certain frequency ranges, frequency bands, or bandwidths. The second transducer 20 is a tweeter configured to output sound in a high-frequency register. The first transducer 18 is a woofer assembly configured to output sound in a lower frequency register than the second transducer 20. The first transducer 18 and the second transducer 20 each have an output side facing the open front side 16 of the enclosure 14 to emit sound therefrom in the forward direction F.

The enclosure 14 includes a first support surface 36 configured to support the loudspeaker 10 in the monitor orientation and a second support surface 40 configured to support the loudspeaker 10 in the upright orientation. In the monitor orientation, the forward direction F is arranged at an upward oblique angle relative to the surface S on which the enclosure 14 is placed. In some embodiments, the upward oblique angle is acute. In some embodiments, the oblique upward angle is more than thirty degrees and less than sixty degrees. In the upright orientation, the forward direction F is parallel to the surface S on which the enclosure 14 is placed.

The first support surface 36 extends from the second support surface 40. The first support surface 36 includes a first set of feet 44 configured to support the enclosure 14 on the surface S in the monitor orientation. The second support surface 40 includes a second set of feet 48 configured to support the enclosure 14 on the surface in the upright orientation. The second support surface 40 further includes a recess 52 configured to receive a post (not shown) on which the enclosure 14 can be mounted. The enclosure 14 also includes a top surface 53 and plurality of exterior walls 54 which in combination with the first and second support surfaces 36, 40 define an interior of the enclosure 14. Each of the walls 54, the first support surface 36, and the open front side 16 extend between the second support surface 40 and the top surface 53.

Figure 4:
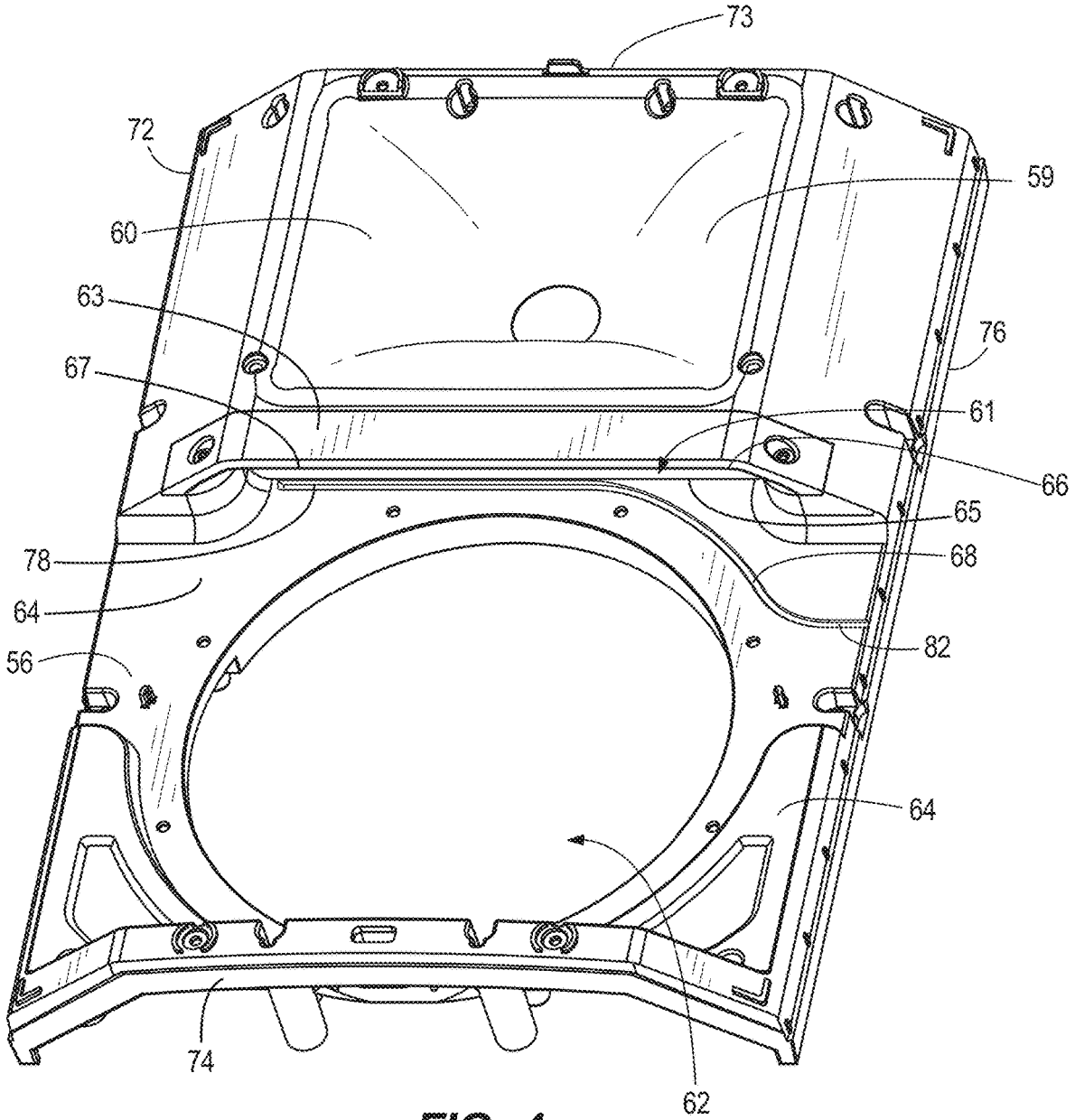
FIG. 4 is a perspective view of a baffle of the loudspeaker of FIG. 1.

With reference to FIGS. 1, 2 and 4, the baffle 22 includes a first portion 56 configured to support the first transducer 18 and a second portion 60 configured to support the second transducer 22. In the illustrated embodiment, the second portion 60 projects further in the forward direction F than the first portion 56. The second portion 60 includes an acoustic horn 59 which includes four sides that flare away from the second transducer 22. The baffle 22 includes a cover, referred to herein as awning 63, adjacent one of the four sides of the acoustic horn 59. A port 61 is formed in the baffle 22 between the first portion 56 and the second portion 60 and between the awning 63 and the first portion 56. The port 61 is fluidly connected to the interior of the enclosure 14 and to an exterior environment around the loudspeaker 10.

In some constructions, the awning 63 may be separable from the baffle 22 (e.g., from the second portion 60) and coupled thereto via fasteners. In some constructions, the awning 63, the first portion 56, and the second portion 60 may be unitarily formed as a single piece. The second portion 60 includes a recess that receives the awning 63 such that when the awning is coupled to the second portion 60, the second portion 60 is flush with the awning 63. The first portion 56 has a first end 65 adjacent the second portion 60. The first end 65 is elongated in a direction of extension that is perpendicular to the forward direction F. The awning 63 extends further in the forward direction F than the first end 65 of the first portion 56. The awning 63 defines an edge 67 at a distal end of the awning 63. The edge 67 of the awning 63 and the first portion 56 define an exterior opening 66 of the port 61. The exterior opening 66 lies in a plane that is parallel to the forward direction F.

The first portion 56 includes an opening 62 configured to receive the first transducer 18. The opening 62 is circular in shape. In other embodiments, the opening 62 can be an oval. The baffle 22 further includes a front surface 64 facing the forward direction F and a trough or channel 68, formed in the front surface 64. In some embodiments, the channel 68 may have a trapezoidal cross-section, a rectangular cross-section or a U-shaped cross-section.

The channel 68 is configured to direct water out of the enclosure 14, when the enclosure is in the monitor orientation. The first transducer 18 is spaced further in the forward direction of at least a portion of the channel 68 so that the first transducer 18 covers the portion of the channel 68. The front surface 64 and the channel 68 are arranged at an acute angle to the first support surface 36, so that when the enclosure 14 is in the monitor orientation, gravity moves the water through the channel 68 to exit the enclosure 14.

With reference to FIG. 4, the baffle 22 includes a first edge 72 extending between a first end 73 and a second end 74 and a second edge 76 extending between the first end 73 and the second end 74 and opposite the first edge 72. The first edge 72 and the second edge 76 are of equal length. The first edge 72 and the second edge 74 are longer than the first end 73 and the second end 74. The first edge 72 is adjacent one of the walls 54 of the enclosure 54 and the second edge 76 is adjacent another one of the walls 54 of the enclosure 54. The first edge 72 is further from the first support surface 36 than the second edge 76. The channel 68 includes a closed end 78 adjacent to and spaced from the first edge 72 and an open end 82 at and open to the second edge 76. In some embodiments, the closed end 78 can be a second open end and may be open to the first edge 72. In some embodiments, the closed end 78 may not be spaced from the first edge 72.

The channel 68 includes a first straight portion 86 including the closed end 78, a curved portion 90 extending from the first straight portion 86, a curved connecting portion 94 extending from the curved portion 90, and a second straight portion 98 extending from the curved connecting portion 94 and including the open end 82. The first straight portion 86, the curved portion 90, the curved connecting portion 94, and the second straight portion 98 are continuous. The first straight portion 86 is arranged adjacent a first end of the curved portion 90, and the second straight portion 98 is arranged adjacent a second end of the curved portion 90 opposite the first end. The curved connecting portion 94 is arranged between the curved portion 90 and the second straight portion 98.

Figure 5:
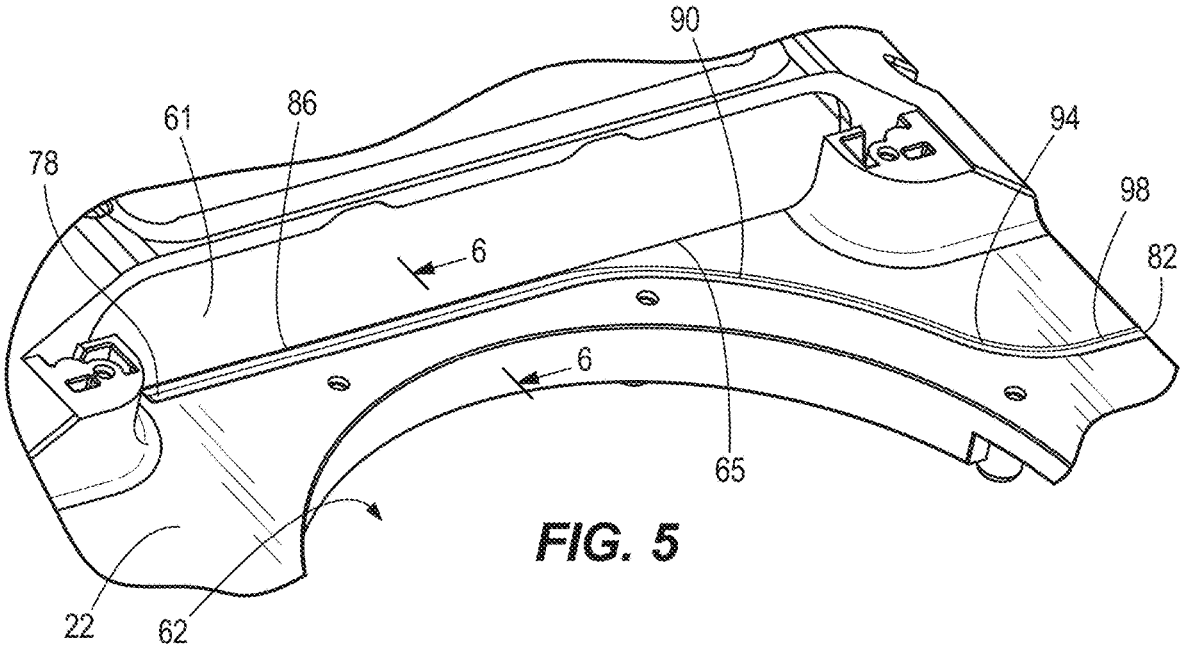
FIG. 5 is an enlarged perspective view of the baffle of the loudspeaker of FIG. 1.
Figure 6:
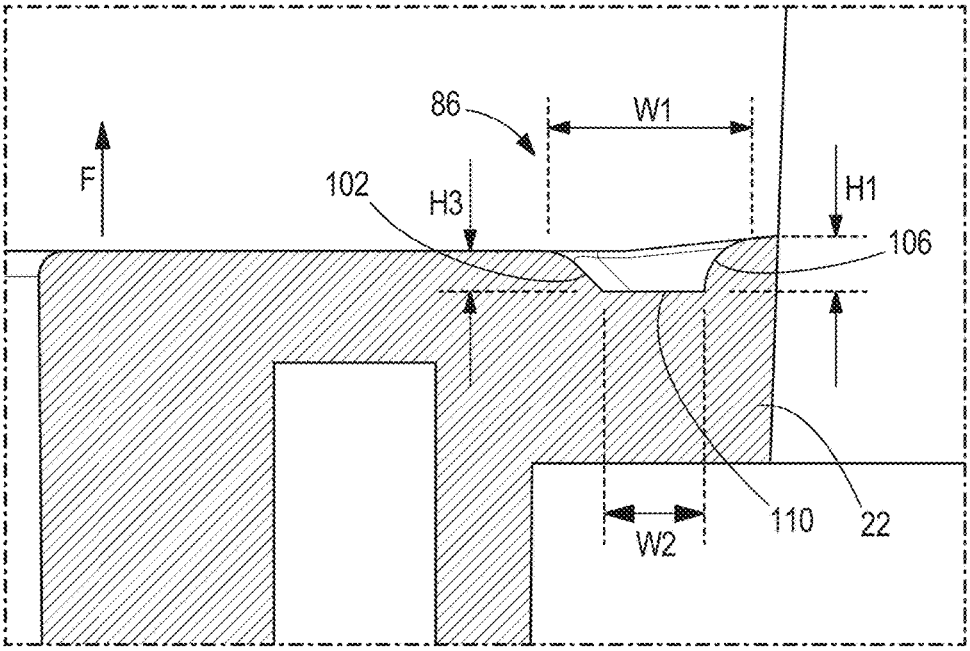
FIG. 6 is an enlarged cross-section view taken along the line 6-6 shown in FIG. 5.

With reference to FIGS. 5 and 6, the first straight portion 86 is arranged adjacent to and along the port 61. The channel 68 has a first wall 102 adjacent the opening 62 and a second wall 106 adjacent the port 61 and opposite the first wall 102. The first wall 102 is continuous and extends along the first straight portion 86, the curved portion 90, the curved connecting portion 94, and the second straight portion 98. The second wall 106 is continuous and extends along the first straight portion 86, the curved portion 90, the curved connecting portion 94, and the second straight portion 98. The channel 68 includes a continuous bottom surface 110 extending along the first straight portion 86, the curved portion 90, the curved connecting portion 94, and the second straight portion 98. The first wall 102 and the second wall 106 extend from opposite sides of the bottom surface 110. The second wall 106 has a first height h1 (FIG. 6) in the first straight portion 86, as measured in the forward direction F (and/or as measured perpendicularly from the bottom surface 110). The second wall 106 has a second height h2 (FIG. 7) in the curved connecting portion 94 and the second straight portion 98, as measured in the forward direction F (and/or as measured perpendicularly from the bottom surface 110). The second height h2 is smaller than the first height h1. The larger first height h1 of the second wall 106 prevents water from exiting the channel 68 into the enclosure 14 via the port 61. The second wall 106 tapers from the first height h1 to the second height h2 in the curved portion 90. A majority of the second wall 106 in the curved portion 90 has the reduced second height h2.

Figure 7:
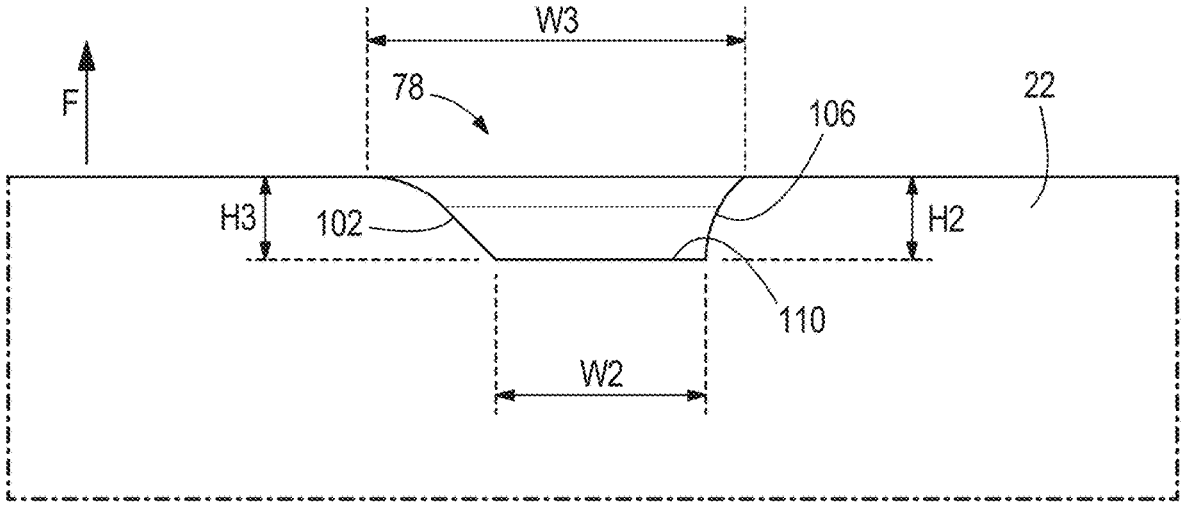
FIG. 7 is an enlarged side view of the baffle of the loudspeaker of FIG. 1.

The first wall 102 has a constant height h3, as measured parallel to the first and second heights h1, h2 of the second wall 106. The first wall 102 has the height h3 in all of the portions 86, 90, 94, and 98. The height h3 of the first wall 102 is the same as the second height h2 of the second wall 106 as shown in FIG. 7. As shown in FIG. 6, the height h3 of the first wall 102 is smaller than the first height h1 of the second wall 106 within the first straight portion 86 of the channel 68.

In the illustrated embodiment, the continuous bottom surface 110 is flat. In other embodiments, the bottom surface 110 may be V-shaped or U-shaped. The first wall 102 and the second wall 106 extend from opposite sides of the bottom surface 110.

In the first straight portion 86, the first wall 102 is angled to the bottom surface 110 as shown in FIG. 6. The term angled should be understood to mean at an angle that is not 0 degrees or 180 degrees. As illustrated, the first wall 102 and the bottom surface 110 are not perpendicular, but are skewed and arranged to form an interior angle of greater than 100 degrees and less than 160 degrees. In the illustrated embodiment, the first wall 102 extends straight from the bottom surface 110, as viewed in perpendicular cross section (FIG. 6), and transitions to be curved as the first wall 102 extends in the forward direction F. As such, the first wall 102 forms a smooth transition to the front of the baffle 22. In some embodiments, the entire first wall 102 may have a curved profile. In some embodiments, the entire first wall 102 may have a straight profile. In the first straight portion 86, the second wall 106 has a curved profile and is curved toward the forward direction F. In some embodiments, the second wall 106 can be curved away from the forward direction F. In some embodiments, the second wall 106 can be straight or have a straight portion that is angled (e.g., skewed, optionally with a similar angle range as the first wall 102) to the bottom surface 110.

In the curved portion 90, the curved connecting portion 94, and the second straight portion 98, the first wall 102 has a curved profile and is convex with respect to the interior of the channel 68. In some embodiments, the first wall 102 may be concave with respect to the interior of the channel 68. In some embodiments, the first wall 102 may have a straight profile that is angled to the bottom surface 110. In the curved portion 90, the curved connecting portion 94, and the second straight portion 98, the second wall 106 has a curved profile and is convex with respect to the interior of the channel 68. In some embodiments, the second wall 106 may be concave with respect to the interior of the channel 68. In some embodiments, the second wall 106 may have a straight profile that is angled to the bottom surface 110.

The width of the channel 68, measured perpendicular to the direction of elongation of the channel 68, increases in the forward direction F, away from the bottom surface 110. In the first straight portion 86, the first wall 102 and the second wall 106 extend away from each other and define a first width W1 at the open side of the channel 68. The bottom surface 110 defines a second width W2 across the channel 68 that is smaller than the first width W1. The second width W2 may be constant along the channel 68 or multiple portions thereof In the curved portion 90, the curved connecting portion 94, and the second straight portion 98, the first wall 102 and the second wall 106 extend away from each other and define a third width W3 at the open side of the channel 68 that is larger than the second width W2 measured at the bottom surface 110. The third width W3 can be the same as or different from the first width W1.

With reference to FIGS. 4 and 5, the first straight portion 86 and the second straight portion 98 are parallel to each other. A length of the first straight portion 86 is greater than the length of the second straight portion 98. The curved portion 90 follows a path established by a portion of a circumference of the opening 62. The curved portion 90 is curved in a first direction and the connecting curved portion 94 is curved in a second direction opposite from the first direction. The connecting curved portion 94 is curved toward the opening 62, or convex facing the opening 62. A radius of the curved portion 90 is larger than a radius of the connecting curved portion 94. A length of the curved portion 90 is greater than the length of the connecting curved portion 94.

The awning 63 is configured to prevent water from entering the enclosure 14 via the port 61. The channel 68 is configured to direct water out of the enclosure 14. The water may be received on the front surface 64 of the baffle 22 through the perforated grille 24. For example, the water may be rainwater when the loudspeaker 10 is placed outside. When water is received on the baffle 22 in the upright orientation, the location of the awning 63 in the forward direction F allows the awning 63 to cover the port 61 and prevent water from entering the enclosure 14 through the port 61. The awning 63 directs the water away from the exterior opening 66 of the port 61. When water is received on the baffle 22 in the monitor orientation, the water cannot fall directly into the enclosure 14 through the port 61 because the exterior opening 66 extends along the forward direction F. In other words, the awning 63 covers the port 61 and blocks water from entering the enclosure 14 through the port 61. Because the front surface 64 is angled from the floor surface S in the monitor orientation, the water is directed along the awning 63 on to the second portion 60 and over an edge of the adjacent wall of the plurality of walls 54 of the enclosure 14. In some embodiments, the water exits the enclosure 14 back through the grille 24. The water may be directed off of the edge 67 the of awning 63 and toward the channel 68 or into the channel 68.

When water is received on the front surface 64 of the baffle 22 in the vicinity of the port 61, at least some of the water flows into the channel 68. Specifically, the water that is not blocked by the awning 63 flows into the channel 68. Most of the water is blocked by the awning 63. Because the front surface 64 is angled to the floor surface S in the monitor orientation, the water is directed along the channel 68, away from the closed end 78, by gravity. The water flows through the first straight portion 86, then through the curved portion 90, then through the curved connecting portion 94, and finally through the second straight portion 98. The water may enter the channel 68 at the closed end 78 or may enter the channel 68 after the closed end 78 in the first straight portion 86, the curved portion 90, the curved connecting portion 94, or the second straight portion 98. The water is directed along the path established by the circumference of the opening 62 when the water is conveyed through the curved portion 90. Because the water is directed in the channel 68, the water is inhibited or prevented from entering the port 61 and is inhibited or prevented from entering the opening 62. The walls 102, 106 of the channel 68 are flared out as described above so that the channel 68 catches water from a wider area than that established by the width W2 along the bottom surface 110 of the channel 68. The height h1 of the wall 106 adjacent the port 61 prevents water from entering the enclosure 14 through the port 61.

The water may not flow through all of the portions 86, 90, 94, and 98 and may only flow through some of the portions 86, 90, 94, and 98. Specifically, the water may enter the channel 68 in the curved portion 90 and may only be conveyed through the curved portion 90, the curved connecting portion 94 and the second straight portion 98. The water may enter the channel 68 in the curved connecting portion 94 and may only be conveyed through the curved connecting portion 94 and the second straight portion 98. The water may enter the channel 68 in the second straight portion 98 and may only be conveyed through the second straight portion 98. The water drains out of the channel 68 through the open end 82 to an exit location and out of the enclosure 14. The water exits through the open end 82 and is conveyed over an edge of the adjacent wall of the plurality of walls 54 of the enclosure 14. In some embodiments, the water exits the enclosure 14 back through the grille 24.

Although the invention has been described in detail with reference to certain preferred embodiments, variations and modifications exist within the scope and spirit of one or more independent aspects of the invention as described.

What is claimed is:

1. A loudspeaker comprising:

an enclosure having an open front side defining a forward direction for projecting sound, a first support surface configured to support the loudspeaker in a monitor orientation, and a second support surface configured to support the loudspeaker in an upright orientation, wherein in the monitor orientation, the forward direction is arranged at an oblique upward angle relative to a surface on which the enclosure is placed;

an audio transducer positioned within the enclosure and configured to emit sound from the open front side of the enclosure; and a baffle securing the audio transducer to the enclosure, the baffle having a front surface facing in the forward direction and a channel formed in the front surface, the channel configured to direct water out of the enclosure in the monitor orientation.

2. The loudspeaker of claim 1, wherein the channel includes a curved portion and a straight portion.

3. The loudspeaker of claim 1, wherein the baffle has an edge adjacent a wall of the enclosure, and wherein the channel has an open end at the edge of the baffle.

4. The loudspeaker of claim 1, wherein the baffle includes an opening configured to receive the audio transducer, and wherein a portion of the channel follows a path established by a portion of a circumference of the opening.

5. The loudspeaker of claim 4, wherein the channel includes a first end spaced from a first edge of the baffle and a second end open to an opposite second edge of the baffle.

6. The loudspeaker of claim 1, wherein a portion of the audio transducer is spaced further in the forward direction of at least a portion of the channel so that the audio transducer covers the portion of the channel.

7. The loudspeaker of claim 1, wherein the channel has a first wall adjacent the audio transducer and a second wall adjacent a port of the loudspeaker, and wherein the second wall extends further in the forward direction than the first wall in a region of the port.

8. A loudspeaker comprising:

an enclosure having an open front side defining a forward direction for projecting sound, a first support surface configured to support the loudspeaker in a monitor orientation, and a second support surface configured to support the loudspeaker in an upright orientation, wherein in the monitor orientation, the forward direction is arranged at an oblique upward angle relative to a surface on which the enclosure is placed;

an audio transducer positioned within the enclosure and configured to emit sound from the open front side of the enclosure;

a baffle positioned in the open front side of the enclosure and having an opening configured to receive the audio transducer, the baffle having a front surface facing the forward direction and having a channel formed in the front surface, the channel having a first wall adjacent the audio transducer and a second wall adjacent a port of the loudspeaker, and wherein the second wall extends further in the forward direction than the first wall in a region of the port, wherein the baffle has a first portion having the channel and a cover disposed further in the forward direction than the first portion, and wherein an edge of the cover and the first portion define an exterior opening of the port.

9. The loudspeaker of claim 8, wherein, the channel has a first straight portion and a curved portion following a path established by a portion of a circumference of the opening, wherein the first straight portion is arranged at a first end of the curved portion, and wherein the channel has a second straight portion arranged at a second end of the curved portion.

10. The loudspeaker of claim 9, wherein the first straight portion and the second straight portion are parallel.

11. The loudspeaker of claim 10, wherein the first straight portion extends along a port of the loudspeaker, the first straight portion of the channel having a first wall adjacent the audio transducer and a second wall adjacent the port, and wherein the second wall extends further in the forward direction than the first wall.

12. The loudspeaker of claim 9, wherein the channel has a curved connecting portion arranged between the second straight portion and the curved portion, and wherein the curved connecting portion curves toward the opening.

13. The loudspeaker of claim 9, wherein the channel includes a first end on the first straight portion and spaced from a first edge of the baffle and a second end on the second straight portion and open to an opposite second edge of the baffle.

14. The loudspeaker of claim 8, wherein the baffle has an edge adjacent a wall of the enclosure, and wherein the channel has an open end at the edge of the baffle.

15. The loudspeaker of claim 8, wherein a portion of the audio transducer is spaced forward of at least a portion of the channel so that the audio transducer covers the portion of the channel.

16. The loudspeaker of claim 8, wherein the channel has a first wall adjacent the audio transducer and a second wall adjacent a port of the loudspeaker, and wherein the second wall extends further in the forward direction than the first wall in a region of the port.

17. A method of channeling water out of a loudspeaker, the method comprising:

providing the loudspeaker having an enclosure having an open front side defining a forward direction for projecting sound, an audio transducer positioned within the enclosure and configured to emit sound from the open front side of the enclosure, and a baffle securing the audio transducer to the enclosure, the baffle having a front surface facing in the forward direction, a channel formed in the front surface, a first portion having the channel and a second portion having a cover disposed further in the forward direction than the first portion, the cover and an end of the first portion defining an exterior opening of the port;

placing the loudspeaker in a monitor orientation on a floor surface such that the forward direction is at an upward oblique angle with respect to the floor surface;

receiving water on the front surface of the baffle;

directing the water over an edge of the cover; and directing the water along the channel by gravity.

18. The method of claim 17, further comprising providing a perforated grille covering the open front side of the enclosure and the baffle, wherein the receiving the water on the front surface of the baffle includes receiving water through the perforated grille.

19. The method of claim 17, wherein directing the water along the channel includes directing the water along a path established by a portion of a circumference of the opening.

20. The method of claim 17, further comprising conveying the water out of an open end of the channel at an edge of the baffle and over an exterior wall of the enclosure, and draining the water out of the channel into an exit location.

* * * * *